US005157892A

United States Patent [19]

Ryther

[11] Patent Number: 5,157,892

[45] Date of Patent: Oct. 27, 1992

[54] STRUCTURAL INTERLOCKING JOINT SYSTEM

[76] Inventor: Ronald R. Ryther, 301 Freeman Rd., #101, Central Point, Oreg. 97502

[21] Appl. No.: 796,921

[22] Filed: Nov. 22, 1991

Related U.S. Application Data

[63] Continuation of Ser. No. 559,198, Jul. 27, 1990, abandoned.

[51] Int. Cl.[5] ..... E04C 2/54

[52] U.S. Cl. ..... 52/785; 52/668; 52/807; 52/820

[58] Field of Search ..... 52/668, 811, 807, 792, 52/716, 718.1, 785, 92, 93, 479, 481, 416, 309-311, 793, 251, 259, 437, 820

[56] References Cited

U.S. PATENT DOCUMENTS

| | | | |
|---|---|---|---|
| 881,074 | 3/1908 | Hoelling et al. | 52/807 |
| 1,287,961 | 12/1918 | Glennie | 52/437 |
| 1,887,814 | 11/1932 | LeGall | 52/807 |
| 2,040,259 | 10/1935 | Johnson | 52/807 X |
| 2,055,339 | 10/1936 | Dalton | 52/808 |
| 3,137,089 | 6/1964 | Smith, II | 52/807 X |
| 3,462,897 | 9/1969 | Weinrott | 52/169.14 |
| 4,894,974 | 1/1990 | Mayhew et al. | 52/807 X |

FOREIGN PATENT DOCUMENTS

| | | | |
|---|---|---|---|
| 264893 | 10/1964 | Australia | 52/807 |

*Primary Examiner*—David A. Scherbel
*Assistant Examiner*—Kien T. Nguyen
*Attorney, Agent, or Firm*—John F. Ingman

[57] ABSTRACT

The invention involves a structural interlocking joint system for structural panels used in building construction. A skeleton is formed of interlocking ribs which engage panel skins which are grooved in a pattern to receive the edges of the interlocked ribs. The grooves of each panel skin are formed with their edges angled away from the groove to provide both a wider opening for insertion of the rib skeleton into the grooves, and to provide, after such joining insertion, a reservoir for any excess glue forced out by the joining process. Along the longitudinal edges of the ribs is formed a uniform channel which provides a defined reservoir for glue of substantially even width and depth between the edge of each rib and the bottom of the corresponding groove within the skin. Thus, in the insertion of a rib within a groove, the glue is directed into a substantially uniform strip within the rib edge channel, maximizing strength and minimizing localized glue overflow. Any overflow which occurs from the rib edge channel is contained by the reservoir formed by the angle-edge grooves in the skin.

7 Claims, 3 Drawing Sheets

STRUCTURAL INTERLOCKING JOINT SYSTEM

This is a continuation of co-pending application Ser. No. 07/559,198, filed on Jul. 27, 1990 is now abandoned.

BACKGROUND OF THE INVENTION

1. Field of the Invention

The invention involves a structural panel for use as a modular wall unit in a building, and more particularly, a structural panel which incorporates a novel structural interlocking joint system.

2. Description of the Prior Art

A typical structural panel, such as a prefabricated building panel, may be used in place of conventional framing at the job site. These prefabricated building panels are manufactured at an off-site manufacturing facility. The panels are then transported to the job site, where they are assembled to construct a building.

Some building panels are constructed as a sandwich-type panel by gluing a skin on each side of a core consisting of urethane foam, verathane foam, styrofoam, and the like. In U.S. Pat. No. 3,462,897 to G.H. Weinrott, issued Aug. 26, 1969, urethane foam was used for the core. This type of core provides very good insulation, but also poses a problem being a fire hazard and emitting toxic fumes when burning. A sandwich-type panel usually requires additional structural members to complete a building.

Certain structural panels have design configurations which create difficulties in manufacturing or which dictate the method and speed by which panels can be manufactured. Most panel systems are very cumbersome to use with automated equipment. Cross-rib configurations used in many panels are very difficult to put into proper position. Due to the complexity of this type of joining system, problems are created in the use of high speed automated assembly equipment, as disclosed in U.S. Pat. No. 2,055,399 to W. Dalton, issued Sep. 22, 1936, and U.S. Pat. No. 1,887,814 to J. Le Gall, issued Nov. 15, 1932.

Other panels have fastening systems such as nails, staples, scews, or tabs and slots. Fasteners and tabs may protrude through the outer surface of the skin, thus prohibiting the panel from having a desirable prefinished face. Currently, most prefabricated building panels require further covering to attain a finished wall. Coverings, such as wood siding, plywood, shingles, and stucco, are applied to the exterior of a building. Coverings are also applied to the interior, which include sheetrock, paneling, wall paper, wood, and plaster. These coverings, both interior and exterior normally are applied at the job site to complete the building.

Many systems use glue to secure the inner structure of their panel. Glue fastening systems usually have one flat surface placed against and glued to another flat surface. In this type of glue joint there may be a high rate of default, caused by improper amounts of glue being retained in the joint. With joints, as disclosed in U.S. Pat. No. 881,074 to J. Hoellig and M. Lidster, issued Mar. 3, 1908, it is almost impossible to get exactly the right amount of glue on the fastening areas.

After glue is applied, and upon the abutting of the structural members, any excess glue will be forced from the joint. When this excess glue is at the perimeter edge of the panel, it must be removed to permit other building components, such as panel joining members, to be used.

Some panels have slots through the skin, as disclosed in U.S. Pat. No. 4,894,974 to Mayhew, et al, issued Jan. 23, 1990. Due to the large cutouts, the slots placed at the corners of this panel may weaken the skin, allowing the corners to be damaged easily. The glue joint design in the Mayhew panel may create a number of defaults between the rib and the skin, and, additionally, requires that the outer perimeter edge be cleaned before any other building member can be applied.

Thus, previously known structural panels suffer from a number of disadvantages:

Many panels are limited in their structural abilities, with weakness resulting in damages to the panels during manufacturing, shipping, and assembly at the job site.

The use of urethane foam, verathane foam, or styrofoam as the core, or as insulation in building panels, creates an extreme fire hazard, and a very toxic situation if burning.

Many prefabricated types of building panels have fastening processes that render them unsuitable as a prefinished panel, in that they require additional interior and exterior coatings, after they are installed, to complete construction of a building.

Prefabricated building panels generally require a considerable amount of additional structural members and processes to complete a building.

Some internal rib design configurations create manufacturing problems. Such designs as tabs fitted through slots in the skins, and ribs fitting into tight grooves, make it very difficult to use high speed automated equipment in the manufacturing process.

The gluing process in some panels creates an additional step in the assembly process, where excess glue requires the cleaning of the outer perimeter edge of the panel, thus increasing the cost in manufacturing the panel.

Glue joints in internal rib structures are usually one flat surface joined to another flat surface with glue inserted between the two surfaces, thereby permitting a high degree of default in the gluing process.

Therefore, it is the overall object of this invention to provide a structural panel having a structural interlocking joint system which provides particularly high strength and resistance to deformation. Objects and advantages of the present invention are:

- to provide a system that is well suited to a prefabricated building panel, as used in a modular wall system;
- to provide a prefinished building panel, suitable for either interior or exterior application;
- to provide a guiding system with grooves having angled edges that allow the use of high speed manufacturing equipment;
- to provide a rib-edge channel as a gluing means that greatly reduces the possibility of gluing defaults by retaining a measured amount of glue between ribs and grooves in the skin, thereby greatly increasing structural strength;
- to utilize the angle-edge grooves as a glue reservoir against overflow;
- to provide a non-hazardous building panel;
- to provide a extremely strong structural panel; and
- to provide a panel capable of using many different types of insulaton and acoustical products.

SUMMARY OF THE INVENTION

The present invention involves a structural interlocking joint system for structural panels used in building construction which is designed to meet the aforementioned objectives.

The invention, in the preferred embodiment, includes a skeleton formed of interlocking first and second ribs with each rib having a first longitudinal edge and a second longitudinal edge. The first ribs and the second ribs interlock, by means of notches, so that the first longitudinal edge of the first ribs and the first longitudinal edge of the second ribs lie substantially in a first plane and the second longitudinal edge of the first ribs and the second longitudinal edge of the second ribs lie substantially in a second plane.

Panel skins are formed with elongated grooves in a pattern so as to receive the skeleton of interlocking first and second ribs. The grooves of each panel skin are formed with their outer edges angled away from the groove to provide both a wider opening for insertion of the rib skeleton into the grooves and to provide, after such joining insertion, a reservoir for any excess glue forced out by the joining process.

The first and second ribs have formed along each of their longitudinal edges a uniform channel, the channel providing a defined reservoir for glue of substantially even width and depth between the edge of each rib and the bottom of the corresponding groove within the skin. Thus in the insertion of a rib within its groove, the glue, having been previously laid in the groove, is directed into an essentially uniform strip within the channel, maximizing strength and minimizing localized glue overflow. Any overflow which occurs is contained by the reservoir formed by the above described angle-edge grooves in the skin.

DESCRIPTION OF THE PREFERRED EMBODIMENT

Figure 1:
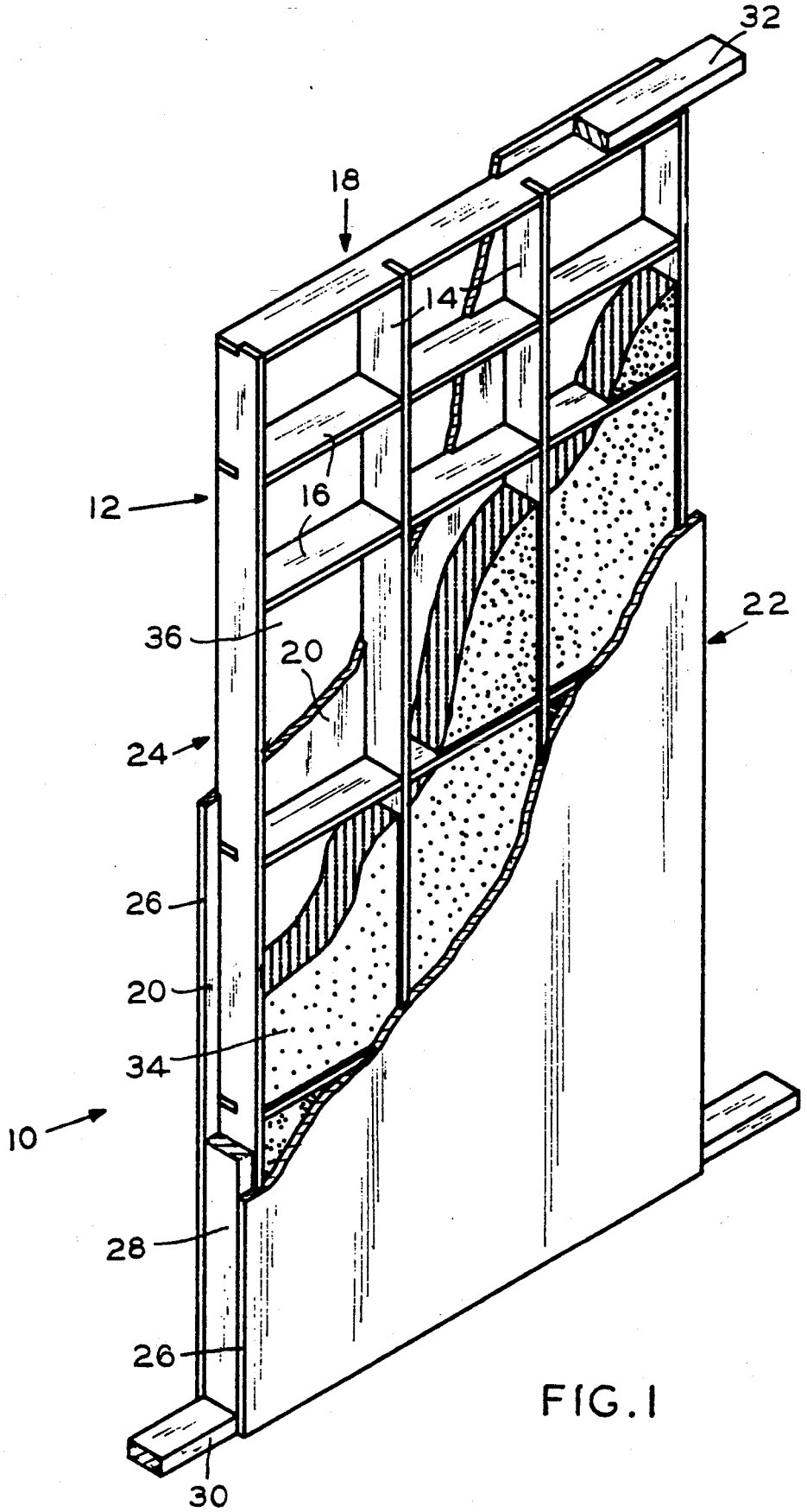
FIG. 1 illustrates a perspective view (partially cut away) of the structural interlocking joint system showing a single structural building panel.

Turning now to the drawings, there is shown in FIG. 1, a perspective view of the preferred embodiment of a building panel 10 utilizing the present structural interlocking joint system 12. The building panel 10 includes a plurality of parallel vertical ribs 14 and a plurality of parallel horizontal ribs 16 which are jointed to form a skeleton structure 18. The ribs 14 and 16 may be disposed at other directions and angles, but the orthogonal relationship is currently preferred for a rectangular building panel 10. The ribs 14 and 16 are typically formed of wood although the advantages remain, regardless of the material used. Skins 20 and 22, providing the surface of the building member 10, are glued to the ribs 14 and 16 as subsequently described. The ribs 14 and 16 about the perimeter 24 of the skeleton structure 18 may be inset from the edge 26 of the skins 20 and 22, so as to permit the use of panel joining members 28 for connection to adjoining building panels 10, sill plates 30 for the building panels 10 to straddle and be fastened to, and top plates 32 to help hold the building panel 10 together and in a straight line.

Insulation 34 may be placed in the voids 36 within the skeleton structure 18 as desired.

Figure 2:
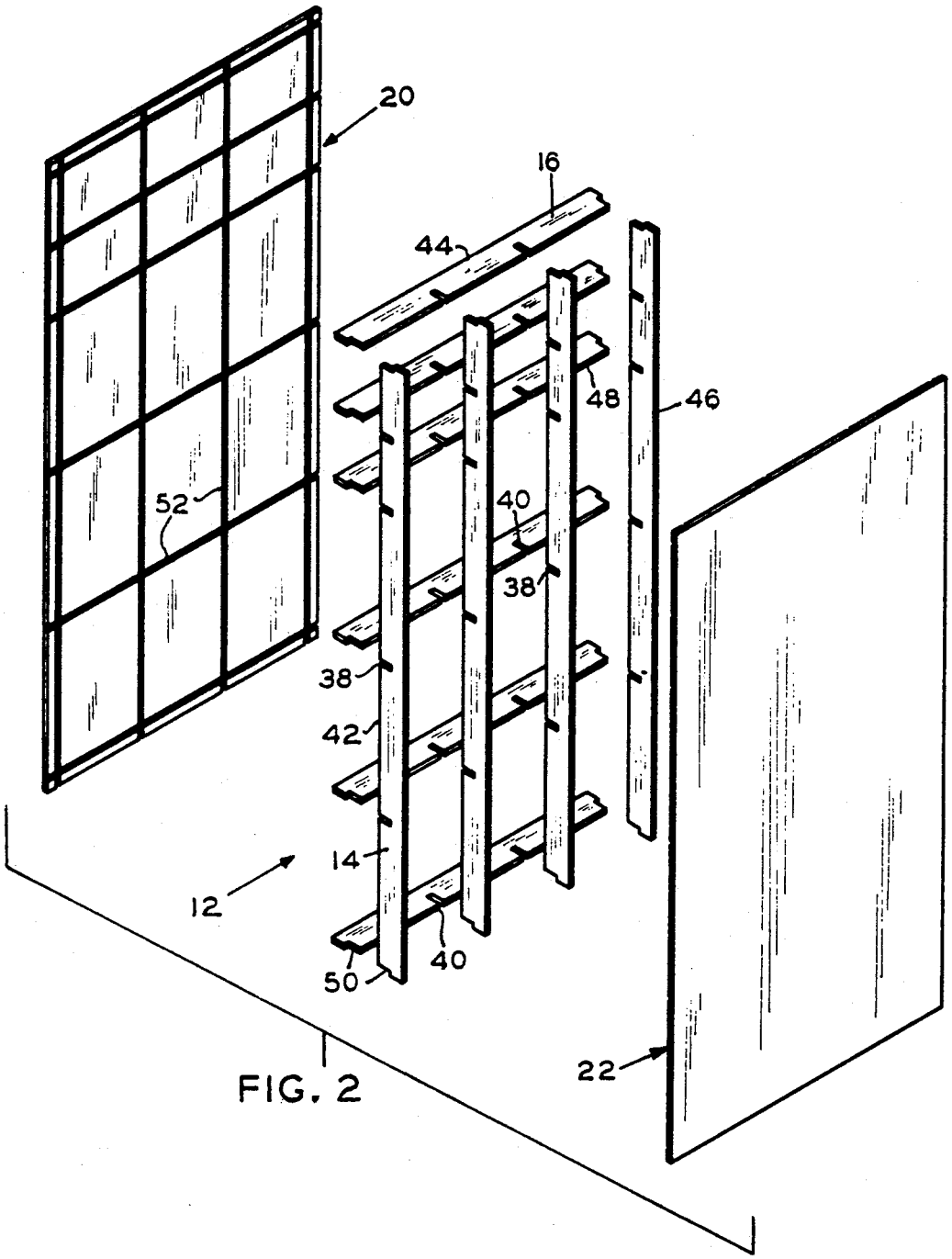
FIG. 2 illustrates an exploded view of the joint system as seen in FIG. 1.

FIG. 2 illustrates an exploded view of the building panel 10 of FIG. 1 wherein the general means of interlocking the ribs 14 and 16 becomes evident. Elongated notches 38 and 40 are formed in ribs 14 and 16, respectively, so as to provide notch 38-to-notch 40 engagement where ribs 14 and 16 intersect. The depth of engaging elongated notches 38 and 40 are designed so that when the ribs 14 and 16 are fully interlocked, as in FIG. 1, the longitudinal edges 42 of ribs 14 and the longitudinal edges 44 of ribs 16 essentially are planar, as are the opposing longitudinal edges 46 of ribs 14 and the longitudinal edges 48 of ribs 16, so as to engage uniformly the planar skins 20 and 22, respectively. Ribs 14 and 16 also preferably include end notches 50 so as to mutually engage, without protrusion, about the perimeter 24 of the skeleton structure 18.

Figure 3:
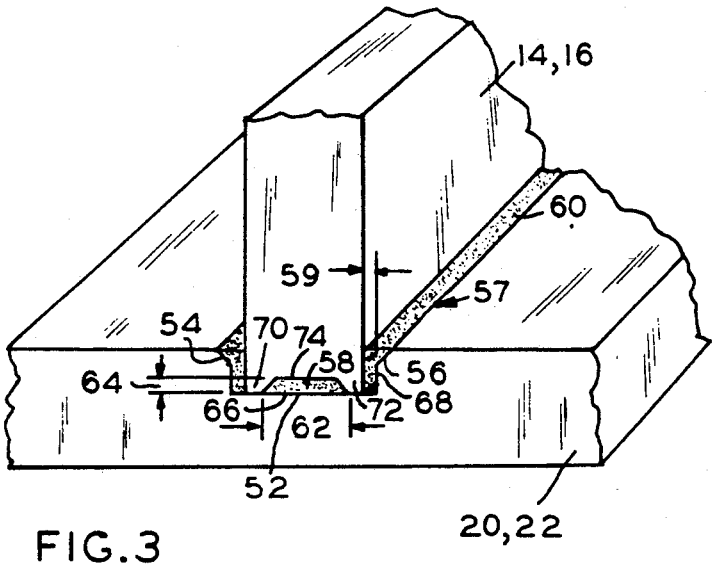
FIG. 3 illustrates an enlarged view of a section of the joint system showing the engagement of a rib within an angle-edge groove formed in a skin.
Figure 4:
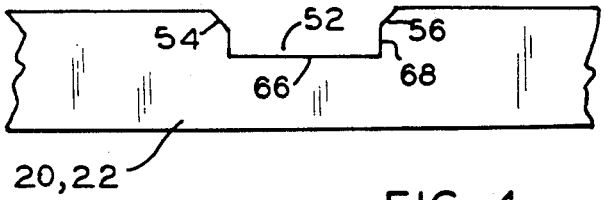
FIG. 4 illustrates an end view of an angle-edge groove formed in a skin.

Within the skins 20 and 22, elongated grooves 52 are formed in a pattern so as to receive the skeleton structure 18 of the interlocking ribs 14 and 16, as best seen in FIG. 2. As seen in FIGS. 3 and 4, the elongated grooves 52, which are machined into the skins 20 and 22, are formed with their edges 54 and 56 angled or beveled away from the groove 52, the angling serving the important dual purpose of (1) providing an initially wider opening for insertion of the longitudinal edges 42, 44, 46, 48 so as to facilitate the use of automated manufacturing processes and (2) providing a reservoir 57 for any excess glue 60 which is forced out of the groove 52 by the insertion of a rib 14 or 16 into its groove 52.

Figure 5:
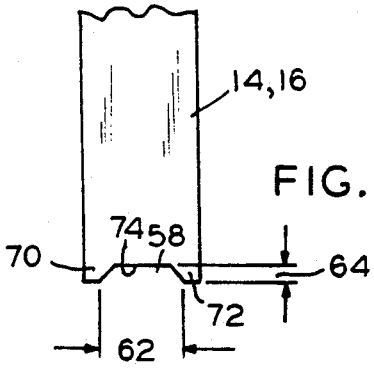
FIG. 5 illustrates an end view of the channel formed in the longitudinal edge of the rib.
Figure 6:
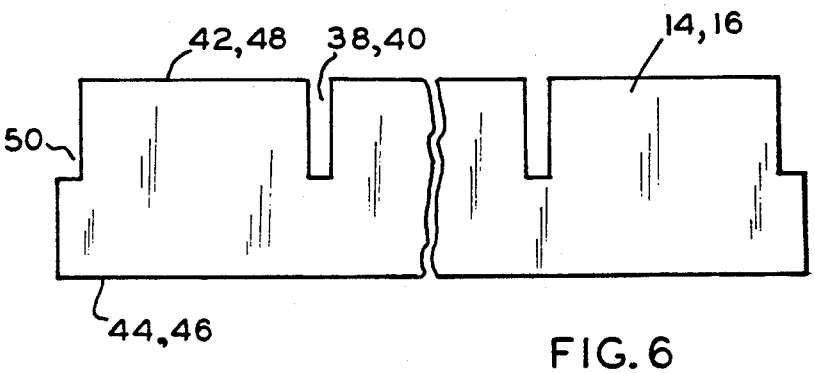
FIG. 6 illustrates an enlarged view of the notches formed in a rib.

As best seen in FIGS. 3 and 5, each of the longitudinal edges 42 and 46 of rib 14 and the longitudinal edges 44 and 48 of rib 16 are formed with a longitudinal channel 58 of uniform cross section. Channel 58 provides a defined reservoir for glue 60 of substantially even width 62 and depth 64 between the edge 42, 44, 46, 48 of the ribs 14, 16 and the bottom 66 of the corresponding groove 52 within the skin 20, 22.

Thus a bead of glue 60 having initially been laid in the bottom 66 of a groove 52, when the longitudinal edge 42, 44, 46, 48 is inserted within the groove 52, the bead of glue 60 will be transformed from its original shape to conform to the shape of the channel 58 both longitudinally and laterally, thereby providing a uniform strip of glue 60 within the channel 58 maximizing strength and minimizing glue 60 overflow from the groove 52. Should glue 60 overflow from the channel 58 and the space 59 between the side of the ribs 14, 16 and the side 68 of the groove 52, it will further be contained by the reservoir 57 formed by the beveled edges 54 and 56.

The control of the glue 60 is important from the standpoint of maximizing strength by eliminating areas of insufficient glue 60 and from restricting its flow outside of the groove 52. If glue 60 build up is permitted outside of the perimeter 24 of the skeleton structure 18, it will interfere with the joining of the building panel 10 to the joining members 28, the sill plates 30, and the top plates 32, all of which fit closely between the skins 20 and 22 without clearance for blobs of excess glue 60. If such excess glue 60 does flow from the grooves 52 onto the skins 20, 22, a separate cleaning operation in the manufacture of the building panel 10 is required, significantly adding to the cost of manufacture.

In a typical preferred rectangular building panel 10 having a thickness of 4 ½-inches, the ribs 14, 16 are formed of 3 ⅞×7/16-inch wood with the skins 20, 22 having a thickness of ½-inch. The groove 52 within the skins 20, 22 is 3/16-inch deep with the angled edges 54 and 56 being 1/16-inch deep at forty-five degrees. A space 59 of 1/32-inch is provided between the side of the ribs 14, 16 and the side 68 of the groove 52. The preferred channel 58 formed along the edge 42, 44, 46, 48 of the 7/16-inch wide ribs 14, 16 has a width 62 of 5/16-inch and a depth 64 of 1/16-inch, and is bordered by legs 70 and 72 of 1/16-inch width which subsequently slope within the channel 58 at 45-degrees for 1/16-inch until meeting the 3/16-inch floor 74 of the channel 58. The cross sectional area thus formed within this so-dimensioned channel 58 is almost exactly the same as the cross-sectional area of a typical ¼-inch bead of glue 60.

It is thought that the structural interlocking joint system 12 of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A structural interlocking joint system, for structural panels used in building construction, comprising:

a. at least one first rib having a first longitudinal edge and an opposing second longitudinal edge;

b. at least one second rib having a first longitudinal edge and an opposing second longitudinal edge;

c. means for interconnection of said first rib and said second rib to form a skeleton for a structural panel so that said first longitudinal edge of said first rib and said first longitudinal edge of said second rib substantially lie in a first plane and said second longitudinal edge of said first rib and said second longitudinal edge of said second rib substantially lie in a second plane;

d. a least one panel skin which is formed with elongated grooves so as to receive said first longitudinal edges of said first rib and said second rib;

e. said first longitudinal edges of said first and second ribs engaging said panel skin within said grooves formed in said panel skin;

f. each of said panel skin-engaging longitudinal edges of said first and second ribs having a longitudinal channel formed therein, said channel being of substantially uniform width and depth so as to form a reservoir to provide uniform distribution and minimize overflow of glue between said edge of said rib and said groove formed within the panel skin.

2. The structural interlocking joint system, for structural panels used in building construction, as recited in claim 1, wherein, additionally, each said elongated groove of said panel skin having a bottom and two sides, said sides of said groove having their outer edges angled so as to form an open space which provides, between said ribs and said elongated grooves, an additional reservoir for any glue which is forced out of the elongated groove by the insertion of said edge of said rib into said elongated groove, and also provides a wider opening to said groove for insertion of said first and second ribs.

3. The structural interlocking joint system, for structural panels used in building construction, as recited in claim 1, wherein said first rib and said second rib are oriented orthoganally.

4. The structural interlocking joint system, for structural panels used in building construction, as recited in claim 1, where there are a plurality of said first ribs and said second ribs, said first ribs being parallel and said second ribs being parallel.

5. The structural interlocking joint system, for structural panels used in building construction, as recited in claim 1, wherein the means for interconnection of said first and second ribs to form said skeleton includes elongated notches formed in said first ribs and second ribs, said notches having a depth so that when said notches of said first rib and said second rib mutually fully engage, said skeleton is formed.

6. A structural interlocking joint system, for structural panels used in building construction, comprising:

a. at least one first rib having a first longitudinal edge and an opposing second longitudinal edge;

b. at least one second rib having a first longitudinal edge and an opposing second longitudinal edge;

c. means for interconnection of said first rib and said second rib to form a skeleton for a structural panel so that said first longitudinal edge of said first rib and said first longitudinal edge of said second rib substantially lie in a first plane and said second longitudinal edge of said first rib and said second edge of said second rib substantially lie in a second plane;

d. at least one panel skin which is formed with elongated grooves so as to receive said first longitudinal edges of said first rib and said second rib; each said elongated groove in said panel skin having a bottom and two sides;

e. said longitudinal edges of said first and second ribs engaging said panel skin within said grooves formed in said panel skin;

f. each of said panel skin engaging longitudinal edges of said first and second ribs having a longitudinal channel formed therein, said channel being of substantially uniform width and depth and extending the full length of said longitudinal edge of said rib, so as to form a reservoir to provide uniform distribution and minimize overflow for glue between said edge of the rib and the bottom of the groove formed within the panel skin.

g. said sides of said groove of said panel skin having their outer edges angled so as to form an open space which provides, between said ribs and said elongated grooves, an additional reservoir for any glue which is forced out of the elongated groove by the insertion of said edge of said rib into said elongated groove, and also which provides a wider opening to said groove for insertion of said first and second ribs;

7. A structural interlocking joint system, for structural panels used in building construction wherein a skeleton of interlocked ribs engages a panel skin formed with a plurality of elongated grooves to receive a plurality of planar longitudinal edges of the ribs, comprising:

a. each of said panel engaging longitudinal edges of said ribs having a longitudinal channel formed therein, said channel being of substantially uniform width and depth to form a reservoir to provide uniform distribution and minimize overflow of glue between said edge of each said rib and said elongated groove within said panel skin; and b. each said elongated groove on said panel skin having a bottom and two sides, said sides of said elongated groove of said panel skin are formed to have an outer edge outwardly angled so as to form an open space which provides, between said ribs and said elongated groove, an additional reservoir for any glue which is forced out of said elongated groove by the insertion of said edge of said rib into said elongated groove, and also which provides a wider opening to said groove for insertion of said rib.

* * * * *